US012096826B2

(12) United States Patent
Ozawa et al.

(10) Patent No.: US 12,096,826 B2
(45) Date of Patent: Sep. 24, 2024

(54) SLIDER

(71) Applicant: YKK Corporation, Tokyo (JP)

(72) Inventors: Takanori Ozawa, Kurobe (JP); Satoshi Nanbo, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/928,093

(22) PCT Filed: Jun. 8, 2020

(86) PCT No.: PCT/JP2020/022560
§ 371 (c)(1),
(2) Date: Nov. 28, 2022

(87) PCT Pub. No.: WO2021/250748
PCT Pub. Date: Dec. 16, 2021

(65) Prior Publication Data

US 2023/0210227 A1 Jul. 6, 2023

(51) Int. Cl.
*A44B 19/26* (2006.01)

(52) U.S. Cl.
CPC ..... *A44B 19/262* (2013.01)

(58) Field of Classification Search
CPC ..... A44B 19/308; A44B 19/262; A44B 19/26; Y10T 24/2577; Y10T 24/2586; Y10T 24/2571
See application file for complete search history.

(56) References Cited

U.S. PATENT DOCUMENTS 4,667,376 A * 5/1987 Ishii ..... A44B 19/308 24/421
4,679,281 A * 7/1987 Ishii ..... A44B 19/308 24/422

(Continued)

FOREIGN PATENT DOCUMENTS

CN 1148949 A 5/1997
CN 102763941 A 11/2012

(Continued)

OTHER PUBLICATIONS

Decision of Rejection, Japanese Patent Application No. 2002-530373, Jun. 27, 2023, 7 pages.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A slider includes a slider body, a tab, and a cover member that is elastically deformable, the slider body has a front attachment post and a rear attachment post standing up from an upper blade, the front attachment post and the rear attachment post have a pair of first side wall portions and a pair of second side wall portions arranged on an outside of the first side wall portions in a length direction, outer wall surfaces of the second side wall portions are arranged on an inside of the first side wall portions via step portions in a width direction, at least a part of the outer wall surfaces of the second side wall portions faces inner wall surface of the cover member. This enables the cover member to be made more difficult to tilt in the width direction even if the cover member receives force.

5 Claims, 10 Drawing Sheets

(56) References Cited

U.S. PATENT DOCUMENTS

| | | | | |
|---|---|---|---|---|
| 5,664,300 | A | 9/1997 | Mizuno | |
| 5,694,667 | A * | 12/1997 | Mizuno | A44B 19/306 24/421 |
| 5,729,874 | A | 3/1998 | Mizuno | |
| 5,924,174 | A * | 7/1999 | Mizuno | A44B 19/306 24/421 |
| 6,993,810 | B2 * | 2/2006 | Hamada | A44B 19/308 24/422 |
| 7,089,632 | B2 * | 8/2006 | Keyaki | A44B 19/26 24/429 |
| 7,257,869 | B2 * | 8/2007 | Lin | A44B 19/262 24/429 |
| 9,060,574 | B2 * | 6/2015 | Lin | A44B 19/24 |
| 9,095,192 | B2 * | 8/2015 | Hamada | A44B 19/262 |
| 9,370,225 | B1 | 6/2016 | Lin | |
| 9,392,847 | B2 * | 7/2016 | Oda | B21D 53/54 |
| 9,770,074 | B2 * | 9/2017 | Lin | A44B 19/262 |
| 2005/0071960 | A1 * | 4/2005 | Bernasconi | A44B 19/308 24/422 |
| 2011/0041297 | A1 | 2/2011 | Iwase | |

FOREIGN PATENT DOCUMENTS

| | | | |
|---|---|---|---|
| JP | H09-168412 | A | 6/1997 |
| JP | 2006-55435 | A | 3/2006 |
| JP | 3202594 | U | 2/2016 |
| WO | 2009/133617 | A1 | 11/2009 |

OTHER PUBLICATIONS

European Application No. 20940049.8, Extended European Search Report mailed on Jun. 16, 2023, 8 pages.

Office Action, Japanese Patent Application No. 2022-530373, Mar. 15, 2023, 8 pages.

International Search Report, PCT Patent Application No. PCT/JP2020/022560, mailed Sep. 1, 2020, 4 pages.

* cited by examiner

SLIDER

TECHNICAL FIELD

The invention relates to a slider used for a slide fastener.

BACKGROUND ART

A slider with an automatic stop mechanism is disclosed in International Publication WO 2009/133617 A1 (Patent Document 1). As shown in FIG. 10, for example, a slider 100 described in this Patent Document 1 is formed using a slider body 101, a tab 102, a spring member 103, and a cover member 104. This slider 100 is assembled by attaching the cover member 104 to front and rear attachment posts 101a of the slider body 101 using elastic deformation of the cover member 104, after the tab 102 and the spring member 103 are placed on the slider body 101. Assembly operations of the slider 100, which is assembled using elastic deformation of the cover member 104 in this way, can be easily performed, and the slider 100 is sometimes called a snap-in-type slider.

PRIOR ART DOCUMENT

Patent Document

Patent Document 1: International Publication WO 2009/133617 A1

SUMMARY OF INVENTION

Problems to be Solved by the Invention

Generally, in a slider, for example, a cover member is sometimes pulled in a width direction of the slider by receiving force from a tab. Therefore, the cover member needs to be attached to a slider body so as not to come off from front and rear attachment posts of the slider body by tilting in the width direction even if the cover member receives such force in the width direction.

According to the slider 100 of Patent Document 1, for example, as the cover member 104 attached to the slider body 101 is in contact with the front and rear attachment posts 101a from an inside in the width direction, the cover member 104 is difficult to tilt in the width direction even if the cover member 104 receives the force in the width direction as described above, and the cover member 104 can be restrained from coming off from the slider body 101. However, it is required that a cover member is prevented from tilting in the width direction more effectively in order to use a slide fastener in various products more stably.

The invention has been made in view of the above conventional problem, and the object of the invention is to provide a slider whose cover member can be made more difficult to tilt in the width direction even if the cover member receives force in the width direction of the slider.

Means for Solving the Problem

In order to achieve the above object, a slider provided by the invention is a slider including a slider body in which an element guide path is formed between an upper blade and a lower blade, a tab having an attachment shaft portion, and a cover member that is elastically deformable, in which the element guide path communicates with right and left shoulder mouths disposed at a front end portion of the slider body in a length direction and a rear mouth disposed at a rear end portion of the slider body in the length direction, in which the slider body has a front attachment post and a rear attachment post standing up from the upper blade, and in which the cover member engages with the front attachment post and the rear attachment post using elastic deformation of the cover member, being characterized in that each of the front attachment post and the rear attachment post has a pair of right and left first side wall portions, and a pair of right and left second side wall portions arranged on an outside of the first side wall portions in the length direction, each outer wall surface of the right and left second side wall portions is arranged on an inside of each outer wall surface of the right and left first side wall portions via a step portion in a width direction, the right and left first side wall portions are exposed outside, at least a part of each of the right and left second side wall portions is accommodated in the cover member, and at least a part of each outer wall surface of the second side wall portions faces an inner wall surface of the cover member.

In the slider according to the invention, it is preferable that the cover member has a cover body portion arranged along the length direction, a front leg portion bending at a front end portion of the cover body portion and extending toward the slider body, and a rear leg portion bending at a rear end portion of the cover body portion and extending toward the slider body, the front leg portion of the cover member engages with the front attachment post of the slider body, and the rear leg portion of the cover member engages with the rear attachment post of the slider body, the cover member has a cover main body portion extending from the front leg portion to the rear leg portion via the cover body portion, and at least each of the front leg portion and the rear leg portion has right and left side surface portions extending from right and left side edge portions of the cover main body portion toward an inner circumferential side of the cover main body portion.

In this case, it is preferable that the cover body portion has right and left side surface portions extending from the right and left side edge portions of the cover main body portion toward the inner circumferential side of the cover main body portion, and in a side surface view of the slider, each lower end portion of the side surface portions arranged on the cover body portion faces each upper end portion of the first side wall portions of the front attachment post and the rear attachment post.

Additionally, it is preferable that each of the right and left side surface portions of the cover member, in a cross-sectional view perpendicular to the width direction of the cover member, has a deformation allowable portion in which a distance between the cover main body portion and an inner circumferential side end edge of the side surface portion is the shortest at a bending part which bends from the cover body portion toward the front leg portion or the rear leg portion.

In the slider of the invention, it is preferable that each of the front attachment post and the rear attachment post has an engaging pawl portion that engages with the cover member, each engaging pawl portion protrudes toward an outside of the second wall portion in the length direction, the cover member has front and rear accommodating hole portions that accommodate each engaging pawl portion, and each of the front and rear accommodating hole portions penetrates the cover member along the length direction.

In this case, each engaging pawl portion of the front attachment post and the rear attachment post has a pawl lower surface that is in contact with the cover member, and each pawl lower surface, in a cross-sectional view perpendicular to the width direction of the engaging pawl portion, has a curved surface that curves in an arc-shape.

Additionally, in the slider of the invention, it is preferable that the slider body has a front recessed channel portion disposed in a front direction of the front attachment post, and a rear recessed channel portion disposed in a rear direction of the rear attachment post.

The Effect of the Invention

According to the slider of the invention, the cover member can be made more difficult to tilt in the width direction even if the cover member receives force in the width direction of the slider.

DESCRIPTION OF EMBODIMENTS

Hereinafter, preferred embodiments of the invention are explained in detail with embodiments referring to drawings. Note that, the invention is not limited to the embodiments described below in any way, various modifications can be made if only they have structure and functional effect substantially identical to the invention.

Embodiment 1

Figure 1:
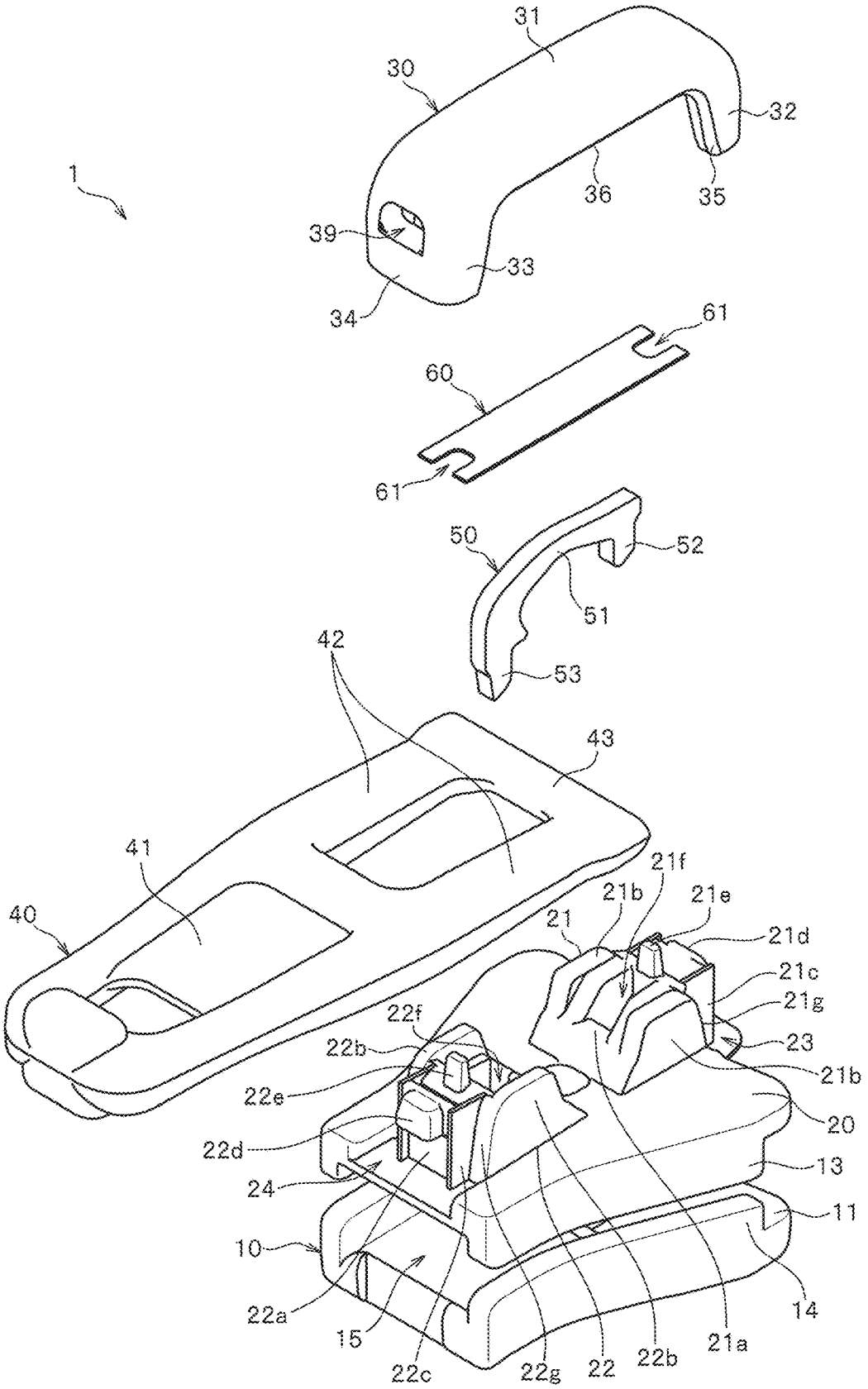
FIG. 1 is a disassembled perspective view schematically illustrating a slider in a disassembled state according to Embodiment 1 of the invention.
Figure 2:
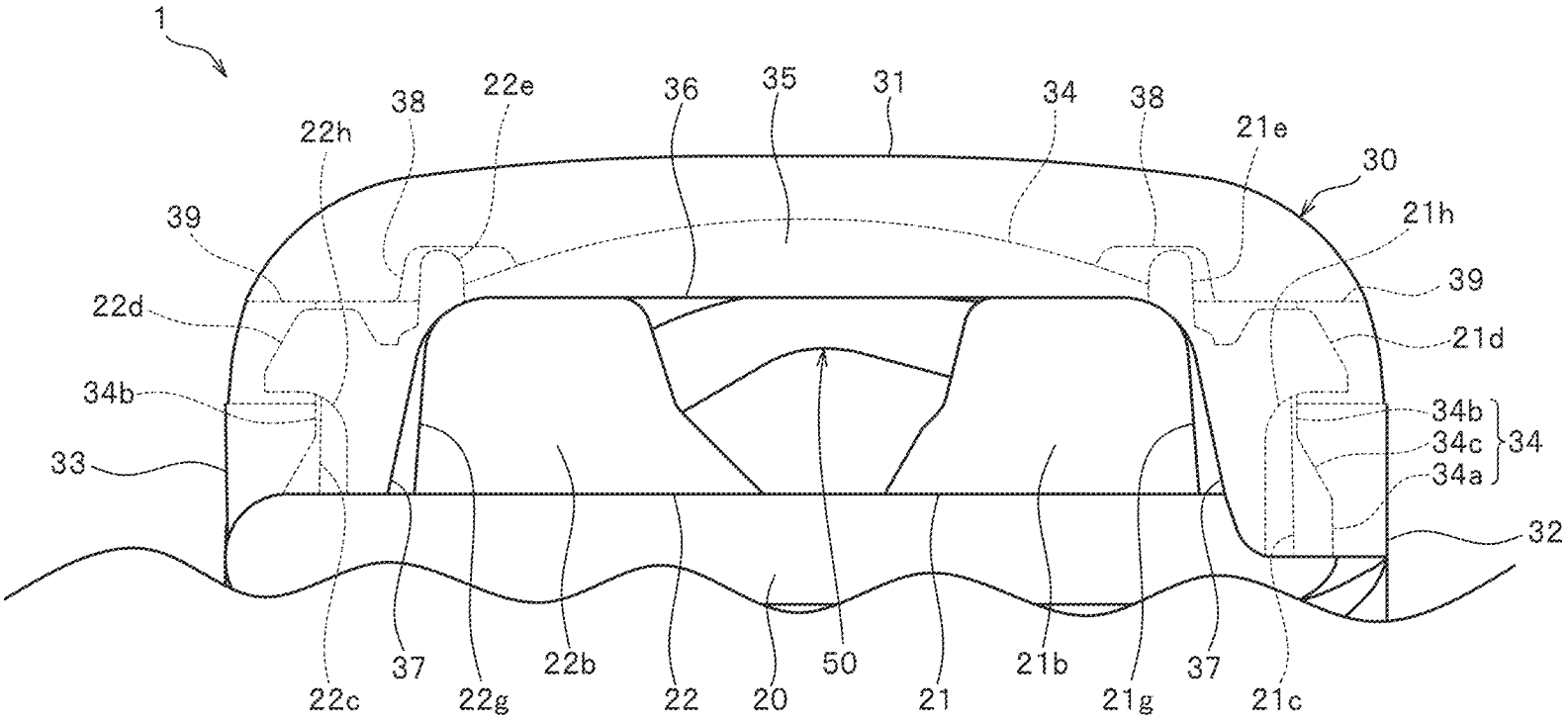
FIG. 2 is a side view of a principal part schematically illustrating the principal part of the slider according to Embodiment 1.
Figure 3:
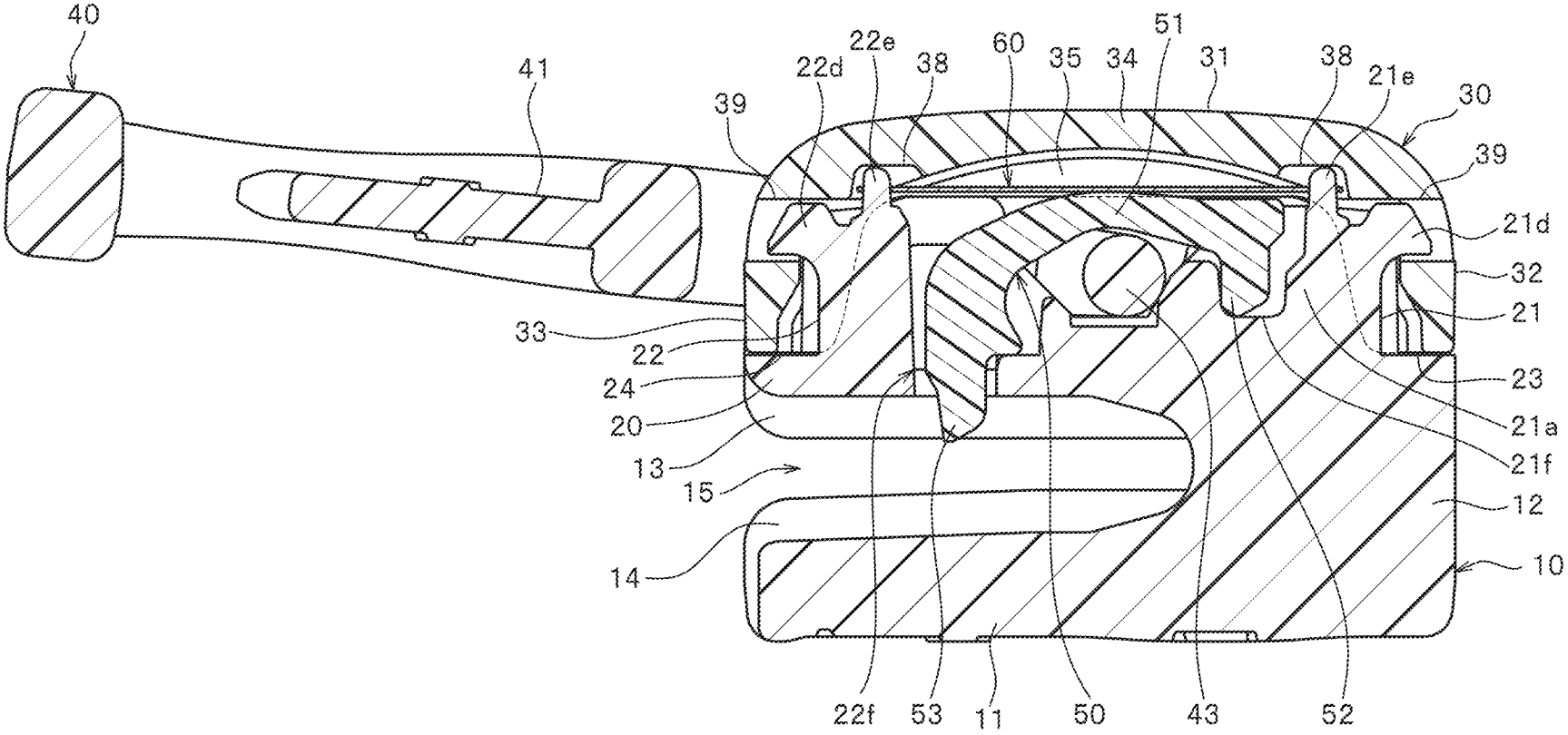
FIG. 3 is a cross-sectional view schematically illustrating a cross-section perpendicular to a width direction of the slider according to Embodiment 1.
Figure 4:
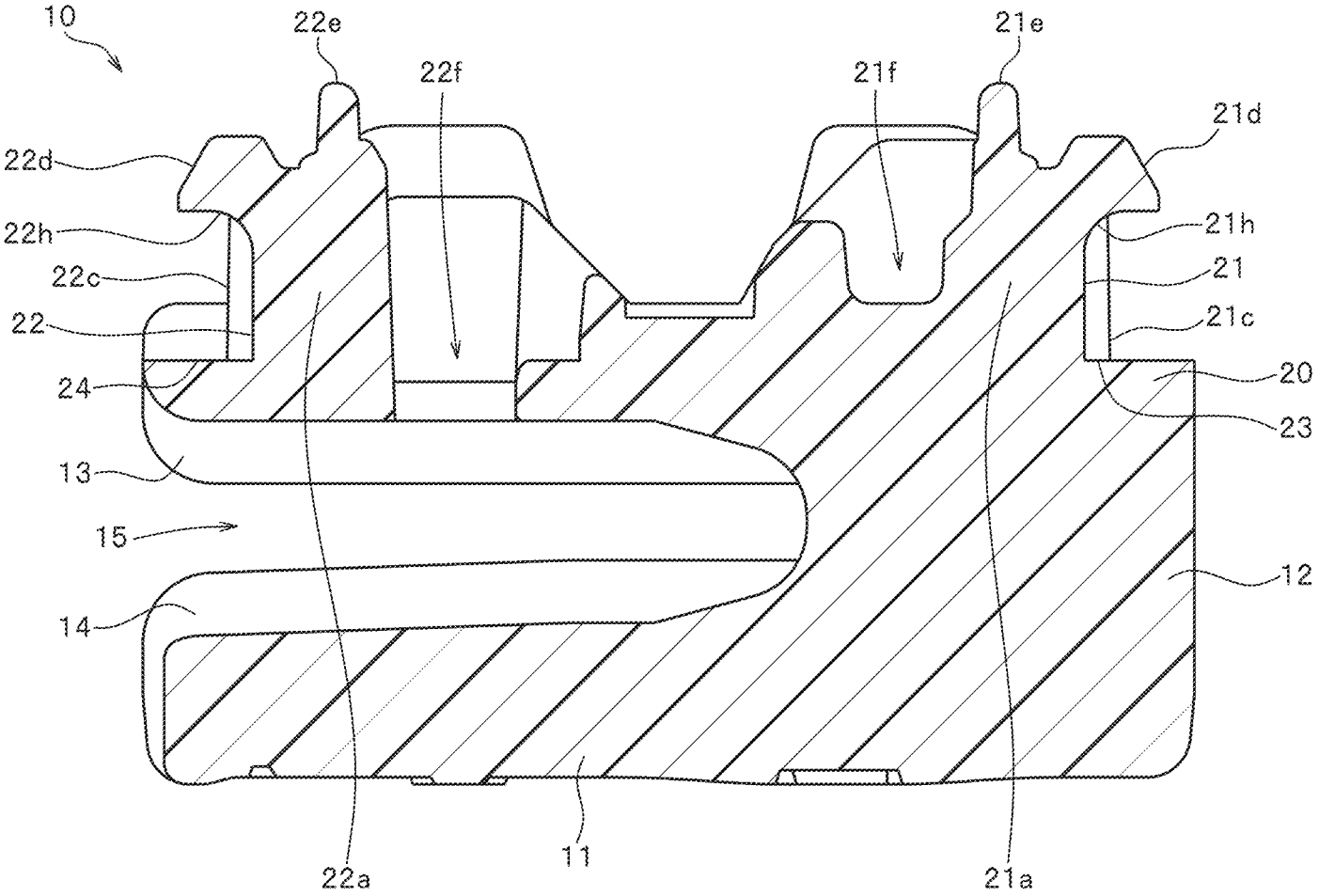
FIG. 4 is a cross-sectional view schematically illustrating a cross-section perpendicular to the width direction of a slider body of the slider according to Embodiment 1.

FIG. 1 is a disassembled perspective view illustrating a slider in a disassembled state according to Embodiment 1. FIG. 2 and FIG. 3 are a side view, and a cross-sectional view perpendicular to a width direction of the slider according to Embodiment 1.

Note that, in the following descriptions, a front and rear direction means a length direction or a sliding direction of the slider. Particularly, when the slider is used for a slide fastener, a direction in which the slider moves to couple right and left element rows is a front direction (a shoulder mouth side direction), and a direction in which the slider moves to separate element rows is a rear direction (a rear mouth side direction). Additionally, an upper and lower direction means a height direction of the slider, for example, the upper and lower direction is a direction perpendicular to a plane upper surface of an upper blade of a slider body. Particularly, a side in which a cover member (or a tab) is attached to the slider body of the slider is an upper direction, and a direction opposite to the upper direction is a lower direction. Furthermore, a right and left direction means the width direction of the slider, that is, a direction perpendicular to the length direction and the height direction of the slider.

A slider 1 for a slide fastener according to Embodiment 1 is formed by five components that are a slider body 10, a tab 40, a stop pawl body 50, a plate spring member 60, and a cover member 30. This slider 1 has an automatic stop mechanism by the stop pawl body 50.

In Embodiment 1, the slider body 10, the tab 40, the stop pawl body 50, and the cover member 30 are formed of synthetic resin having thermal plasticity. The plate spring member 60 is formed of metal. Note that, material of the slider in the invention is not particularly limited, and can be changed. For example, at least one of the components of the slider body, the tab, the stop pawl body, and the cover member may be formed of metal.

The slider body 10 has an upper blade 20, a lower blade 11 arranged parallel to the upper blade 20, a connecting post 12 that connects a front end portion (a shoulder mouth side end portion) of the upper blade 20 and a front end portion (a shoulder mouth side end portion) of the lower blade 11, right and left upper flange portions 13 disposed on right and left side portions of the upper blade 20, and right and left lower flange portions 14 disposed on right and left side portions of the lower blade 11.

The slider body 10 has a front attachment post (a first attachment post) 21 and a rear attachment post (a second attachment post) 22 standing up from the upper blade 20 in the upper direction, a front recessed channel portion 23 disposed in the front direction of the front attachment post 21, and a rear recessed channel portion 24 disposed in the rear direction of the rear attachment post 22. In this case, the front attachment post 21 and the rear attachment post 22 are arranged apart from each other in the front and rear direction, and a space in which an attachment shaft portion 43 of the tab 40, described below, can be inserted is disposed between the front attachment post 21 and the rear attachment post 22.

Right and left shoulder mouths are formed to interpose the connecting post 12 therebetween at a front end portion of the slider body 10. A rear mouth is formed at a rear end portion of the slider body 10. An element guide path 15 that is a substantially Y-shape is formed to communicate the right and left shoulder mouths to the rear mouth between the upper blade 20 and the lower blade 11 of the slider body 10. Tape inserting spaces in which fastener tapes of the slide fastener (not shown) are inserted to pass are disposed at right and left side edge portions of the slider body 10. In this case, the right and left tape inserting spaces of the slider body 10 are formed between the right and left upper flange portions 13 and the right and left lower flange portions 14.

The front attachment post 21 of Embodiment 1 has a front base portion 21*a* arranged at a middle portion in the width direction of the upper blade 20, a pair of right and left front first side wall portions 21*b*, a pair of right and left front second side wall portions 21*c* arranged on an outside (the front direction) of the front first side wall portions 21*b* in the length direction, a front engaging pawl portion 21*d* protruding from the front base portion 21*a* in the front direction, a front protruding portion 21*e* protruding from the front base portion 21*a* in the upper direction, and a pawl accommodating recessed portion 21*f* disposed at a rear end portion of the front base portion 21*a*.

The right and left front first side wall portions 21*b* of the front attachment post 21 are integrally disposed with the front base portion 21*a* on both right and left sides of the front base portion 21*a*. Each of the right and left front first side wall portions 21*b* has an outer wall surface arranged perpendicular to the width direction of the slider 1, and the right and left outer wall surfaces are formed in plane flat surfaces.

The outer wall surfaces of the front first side wall portions 21*b* are exposed outside, not being accommodated in the cover member 30 attached to the slider body 10. In this case, the outer wall surfaces of the front first side wall portions 21*b* are disposed parallel to outside surfaces of a front leg portion 32 of the cover member 30 attached to the slider body 10, described below, at the same positions or substantially the same positions as the outside surfaces of the front leg portion 32 of the cover member 30 in relation to the width direction of the slider 1 to form the same flat surfaces or substantially the same flat surfaces as the outside surfaces.

Upper end portions (top end portions) of the right and left front first side wall portions 21*b* have upper end surfaces (top end surfaces) arranged parallel to an upper surface of the upper blade 20. The upper end surfaces of the front first side wall portions 21*b* face lower end portions of right and left side surface portions 35 of a cover body portion 31 of the cover member 30, described below. In the case of Embodiment 1, in particular, the upper end surfaces of the front first side wall portions 21*b* are in contact with the lower end portions of the right and left side surface portions 35 of the cover body portion 31, thereby support a cover main body portion 34 from below.

The right and left front second side wall portions 21*c* of the front attachment post 21 are accommodated in the cover member 30 attached to the slider body 10. In this case, at least a part of each of the front second side wall portions 21*c* is accommodated in the front leg portion 32 of the cover member 30 and covered so that it cannot be seen from the outside by the front leg portion 32. The right and left front second side wall portions 21*c* extend from the front first side wall portions 21*b* via step portions 21*g* in the front direction.

The right and left front second side wall portions 21*c* protrude in the front direction of a front end surface of the front base portion 21*a*. Additionally, the front second side wall portions 21*c* have front end edges along the upper and lower direction. This enables the right and left front second side wall portions 21*c* to be easily in contact with a part of the cover member 30 (the cover main body portion 34 of the front leg portion 32), thereby a position of the cover member 30 with respect to the slider body 10 in the front and rear direction can be made stable. The cover member 30 can also be restrained from rattling in the front and rear direction.

Outer wall surfaces of the right and left front second side wall portions 21*c* are formed in plane surfaces perpendicular to the width direction. Note that, in the invention, the outer wall surfaces of the right and left front second side wall portions 21*c* may be arranged inclined to the length direction of the slider 1. The outer wall surfaces of the front second side wall portions 21*c* are arranged on an inside of the outer wall surfaces of the front first side wall portions 21*b* in the width direction, and the step portions 21*g*, described above, are disposed between the outer wall surfaces of the front first side wall portions 21*b* and the outer wall surfaces of the front second side wall portions 21*c*. Thus, a distance between the outer wall surfaces of the right and left front second side wall portions 21*c* is smaller than a distance between the outer wall surfaces of the right and left front first side wall portions 21*b*. Additionally, in the case of Embodiment 1, the step portions 21*g* of the front attachment post 21 are sloped downward toward the front direction in a side surface view of the slider body 10.

As the step portions 21*g* being disposed as described above, the outer wall surfaces of the front second side wall portions 21*c* can be stably positioned on the inside of the outer wall surfaces of the front first side wall portions 21*b* in the width direction. Additionally, in attaching the cover member 30 to the slider body 10, the front leg portion 32 of the cover member 30 can be guided toward a predetermined position by sliding contact with the step portions 21*g* of the front attachment post 21. This enables the front leg portion 32 of the cover member 30 to engage with the front engaging pawl portion 21*d* of the front attachment post 21 easily and smoothly. Thus, workability of assembly operations of the slider 1 can be improved.

Furthermore, a thickness (dimensions in the width direction) of the side surface portions 35 of the front leg portion 32 of the cover member 30, described below, can be absorbed by the step portions 21*g* of the front attachment post 21, and thereby, as described above, the outer wall surfaces of the front first side wall portions 21*b* and the outside surfaces of the front leg portion 32 of the cover member 30 can be disposed on the same flat surfaces without a level difference, or on substantially the same flat surfaces with an extremely small level difference. As a result, a visual aspect of the slider 1 can be improved, and its appearance quality can be enhanced. Touch feeling of the slider 1 can also be improved, and fingers, other members, and the like, can be made difficult to be caught by the slider 1.

Each plane outer wall surface of the right and left front second side wall portions 21*c* has a part that faces each of right and left inner wall surfaces of the front leg portion 32 of the cover member 30. In the case of Embodiment 1, in particular, the outer wall surfaces of the right and left front second side wall portions 21*c* are arranged to be in contact with or be close to the right and left inner wall surfaces of the front leg portion 32 of the cover member 30 from the inside. Additionally, as the front second side wall portions 21*c* being disposed on an inside of the front leg portion 32 of the cover member 30, in a side surface view of the slider 1 (see FIG. 2), regions (areas) in which the outer wall surfaces of the front second side wall portions 21*c* and the inner wall surfaces of the cover member 30 are in contact with each other or superposed with each other are secured larger than regions in which, for example, the slider body 101 and the cover body 104 of the slider 100 described in Patent Document 1 are in contact with each other. Accordingly, as described below, the cover member 30 can be made difficult to tilt in the width direction, and attachment strength of the cover member 30 with respect to the slider body 10 can be enhanced.

The front engaging pawl portion 21*d* of the front attachment post 21 is arranged between the right and left front second side wall portions 21*c* in the width direction, and as shown in FIG. 2, for example, protrudes in the front direction of the right and left front second side wall portions 21*c*. The front engaging pawl portion 21*d*, in a cross-sectional view perpendicular to the width direction of the front engaging pawl portion 21*d*, has a pawl upper surface, an inclined surface sloping downward from the pawl upper surface toward a tip end portion of the front engaging pawl portion 21*d*, and a pawl lower surface 21*h* arranged from the tip end portion of the front engaging pawl portion 21*d* to the front end surface of the front base portion 21*a*. Additionally, the pawl lower surface 21*h* of the front engaging pawl portion 21*d*, in a cross-section perpendicular to the width direction, has a depressed-surface-shaped curved surface that curves in an arc-shape.

For example, when the tab 40 is operated and the cover member 30 is pulled up by the attachment shaft portion 43 of the tab 40, a part of the cover member 30 (specifically, the cover main body portion 34 of the front leg portion 32) is in contact with the pawl lower surface 21*h* of the front engaging pawl portion 21*d*, and the pawl lower surface 21*h* of the front engaging pawl portion 21*d* receives a load (stress) from the cover member 30. At this time, as the curved surface as described above being disposed on the pawl lower surface 21*h*, the load applied to the front engaging pawl portion 21*d* from the cover member 30 can be made easy to disperse, and the load can be made difficult to concentrate on a part of the front engaging pawl portion 21*d*. For this reason, it is possible to restrain from damage, and the like, to occur in the front engaging pawl portion 21*d* and the front base portion 21*a*.

The front protruding portion 21*e* of the front attachment post 21 protrudes from the front base portion 21*a* in the upper direction at a position between the front engaging pawl portion 21*d* and the pawl accommodating recessed portion 21*f* in the front and rear direction. The front protruding portion 21*e* is inserted in an attachment hole portion 61 disposed on the plate spring member 60, described below, and thereby a position of a front end portion of the plate spring member 60 with respect to the slider body 10 is determined.

The pawl accommodating recessed portion 21*f* of the front attachment post 21 is formed from an upper surface of the front base portion 21*a* toward the lower direction. A bottom surface portion that supports a spindle portion 52 of the stop pawl body 50, described below, is formed at a lower end portion of the pawl accommodating recessed portion 21*f*. Additionally, the pawl accommodating recessed portion 21*f* is arranged at a position interposed by the right and left front first side wall portions 21*b*.

The rear attachment post 22 of Embodiment 1 has a rear base portion 22*a* arranged at a middle portion in the width direction of the upper blade 20, a pair of right and left rear first side wall portions 22*b*, a pair of right and left rear second side wall portions 22*c* arranged on an outside (in the rear direction) of the rear first side wall portions 22*b* in the length direction, a rear engaging pawl portion 22*d* protruding from the rear base portion 22*a* in the rear direction, and a rear protruding portion 22*e* protruding from the rear base portion 22*a* in the upper direction. Additionally, a pawl hole 22*f* that penetrates the rear attachment post 22 and the upper blade 20 in the upper and lower direction and communicates with the element guide path 15 is disposed on the rear base portion 22*a*.

Although the rear first side wall portions 22*b*, the rear second side wall portions 22*c*, the rear engaging pawl portion 22*d*, and the rear protruding portion 22*e* of the rear attachment post 22 of Embodiment 1 are formed in the opposite direction of the front and rear direction to corresponding portions of the front attachment post 21 that are the front first side wall portions 21*b*, the front second side wall portions 21*c*, the front engaging pawl portion 21*d*, and the front protruding portion 21*e*, they are formed substantially same as each corresponding portion of the front attachment post 21. Hereinafter, brief descriptions are explained regarding the rear first side wall portions 22*b*, the rear second side wall portions 22*c*, the rear engaging pawl portion 22*d*, and the rear protruding portion 22*e*.

The right and left rear first side wall portions 22*b* are integrally disposed with the rear base portion 22*a*, and have plane outer wall surfaces arranged perpendicular to the width direction of the slider 1. These outer wall surfaces of the rear first side wall portions 22*b* are exposed outside. Additionally, the outer wall surfaces of the rear first side wall portions 22*b* are arranged parallel to outside surfaces of a rear leg portion 33 of the cover member 30 attached to the slider body 10, described below, at the same positions or at substantially the same positions as the outside surfaces of the rear leg portion 33 in relation to the width direction of the slider 1, and thereby the outer wall surfaces of the rear first side wall portions 22*b* and the outside surfaces of the rear leg portion 33 of the cover member 30 are disposed on the same flat surfaces, or substantially the same flat surfaces.

Upper end portions (top end portions) of the right and left rear first side wall portions 22*b* have upper end surfaces (top end surfaces) arranged parallel to the upper surface of the upper blade 20. The upper end surfaces of the rear first side wall portions 22*b* face the lower end portions of the right and left side surface portions 35 of the cover body portion 31 of the cover member 30, and in the case of Embodiment 1, in particular, are in contact with the lower end portions of the right and left side surface portions 35 of the cover body portion 31.

The right and left rear second side wall portions 22*c* are accommodated in the cover member 30 attached to the slider body 10. In this case, at least a part of the rear second side wall portion 22*c* is accommodated in the rear leg portion 33 of the cover member 30 and covered so that it cannot be seen from the outside by the rear leg portion 33. The right and left rear second side wall portions 22*c* extend from the rear first side wall portions 22*b* via step portions 22*g*, and protrude in the rear direction of a rear end surface of the rear base portion 22*a*. Rear end edges of the rear second side wall portions 22*c* are along the upper and lower direction. This enables the right and left rear second side wall portions 22*c* together with the right and left front second side wall portions 21*c* to make a position of the cover member 30 with respect to the slider body 10 in the front and rear direction stable, and restrain the cover member 30 from rattling in the front and rear direction.

Outer wall surfaces of the right and left rear second side wall portions 22*c* are formed in plane surfaces perpendicular to the width direction. Note that, the outer wall surfaces of the right and left rear second side wall portions 22*c* may be arranged inclined to the length direction of the slider 1. The outer wall surfaces of the rear second side wall portions 22*c* are arranged on an inside of the outer wall surfaces of the rear first side wall portions 22*b*. Additionally, the step portions 22*g* are sloping downward toward the rear direction in a side surface view of the slider body 10.

As such step portions 22*g* being disposed on the rear attachment post 22, in attaching the cover member 30 to the slider body 10, the rear leg portion 33 of the cover member 30 can be guided by the step portions 22*g*. This enables the rear leg portion 33 of the cover member 30 to engage with the rear engaging pawl portion 22*d* of the rear attachment post 22 easily and smoothly. Furthermore, a thickness of the side surface portions 35 of the rear leg portion 33 of the cover member 30 can be absorbed by the step portions 22*g*, and thereby the outer wall surfaces of the rear first side wall portions 22*b* and the outside surfaces of the rear leg portion 33 of the cover member 30 can be disposed on the same flat surfaces, or substantially the same flat surfaces. As a result, appearance quality of the slider 1 can be enhanced.

Each outer wall surface of the right and left rear second side wall portions 22*c* has a part that faces each inner wall surface of the rear leg portion 33 of the cover member 30. In the case of Embodiment 1, in particular, the outer wall surfaces of the right and left rear second side wall portions 22*c* are arranged to be in contact with or be close to the inner wall surfaces of the rear leg portion 33 of the cover member 30, and similar to the outer wall surfaces of the front second side wall portions 21*c* as described above, in a side surface view of the slider 1 (see FIG. 2), regions in which the outer wall surfaces of the rear second side wall portions 22*c* and the inner wall surfaces of the cover member 30 are in contact with each other or superposed with each other are secured large.

The rear engaging pawl portion 22*d* of the rear attachment post 22 protrudes in the rear direction of the right and left rear second side wall portions 22*c*. The rear engaging pawl portion 22*d*, in a cross-sectional view perpendicular to the width direction of the rear engaging pawl portion 22*d*, has a pawl upper surface, an inclined surface sloping downward from the pawl upper surface toward a tip end portion of the rear engaging pawl portion 22*d*, and a pawl lower surface 22*h* arranged from the tip end portion of the rear engaging pawl portion 22*d* to the rear end surface of the rear base portion 22*a*. Additionally, the pawl lower surface 22*h* of the rear engaging pawl portion 22*d*, in a cross-section perpendicular to the width direction, has a depressed-surface-shaped curved surface that curves in an arc-shape. Thereby, a load applied to the rear engaging pawl portion 22*d* from the cover member 30 can be made easy to disperse, and it is possible to restrain from damage, and the like, to occur in the rear engaging pawl portion 22*d* and the rear base portion 22*a*.

The rear protruding portion 22*e* protrudes from the rear base portion 22*a* in the upper direction at a position between the rear engaging pawl portion 22*d* and the pawl hole 22*f* in the front and rear direction. The rear protruding portion 22*e* is inserted in the attachment hole portion 61 of the plate spring member 60, and thereby a position of a rear end portion of the plate spring member 60 with respect to the slider body 10 is determined.

The front recessed channel portion 23 that can accommodate a front side lower end portion of the cover member 30 is disposed at a front end portion of the upper blade 20, and a rear recessed channel portion 24 that can accommodate a rear side lower end portion of the cover member 30 is disposed at a rear end portion of the upper blade 20. As such front recessed channel portion 23 and rear recessed channel portion 24 being disposed on the slider body 10, it becomes easy to make the all height dimensions of the slider 1 from a lower surface of the lower blade 11 to an upper surface of the cover member 30 small. Additionally, a part of each of the front leg portion 32 and the rear leg portion 33 (a thick portion 34*b*) of the cover member 30, described below, can be made easy to be inserted in each lower side of the front engaging pawl portion 21*d* and the rear engaging pawl portion 22*d* of the slider body 10.

The tab 40 of Embodiment 1 has a tab main body portion 41 picked by fingers, and the like, right and left arm portions 42 extending from one end portion of the tab main body portion 41, and the attachment shaft portion (a link portion) 43 that connects between tip end portions of the right and left arm portions 42. A cross-section perpendicular to a shaft direction of the attachment shaft portion 43 shows a circular shape. An open window portion having a rectangular shape surrounded by the tab main body portion 41, the right and left arm portions 42, and the attachment shaft portion 43 is formed on the tab 40. Note that, in the invention, the shape, size, material, and the like of the tab 40 are not particularly limited.

The stop pawl body 50 of Embodiment 1 has a pawl main body portion 51 showing a substantially C-shape or a substantially J-shape in a side surface view of the stop pawl body 50, the spindle portion 52 extending from a front end portion of the pawl main body portion 51 in the lower direction, and a pawl portion 53 protruding from a rear end portion of the pawl main body portion 51 in the lower direction. The pawl main body portion 51 is arranged to pass over an upper side of the attachment shaft portion 43 of the tab 40 at least between the front attachment post 21 and the rear attachment post 22.

The stop pawl body 50 is attached to the slider body 10 in a posture in which the spindle portion 52 is accommodated in the pawl accommodating recessed portion 21*f* of the front attachment post 21 to make a tip end portion of the spindle portion 52 be in contact with the bottom surface portion of the pawl accommodating recessed portion 21*f*, as well as the pawl portion 53 is inserted in the pawl hole 22*f* of the rear attachment post 22. Additionally, the stop pawl body 50 is arranged swingable or rotatable at a contacting portion of the spindle portion 52 and the bottom surface portion between the pawl accommodating recessed portion 21*f* as a fulcrum. As the stop pawl body 50 being swung or rotated, the pawl portion 53 can be entered in or exit from the element guide path 15 of the slider body 10.

The plate spring member 60 of Embodiment 1 is formed by punching a metal piece having a predetermined shape from a continuous elongated metal plate member, such as stainless steel. The attachment hole portions 61 that open as cutting inward from a front end edge and a rear end edge of the plate spring member 60 are respectively formed at one end portion (a front end portion) and the other end portion (a rear end portion) of the plate spring member 60. This plate spring member 60 is attached to the slider 1 by being held between the front attachment post 21 and the rear attachment post 22 of the slider body 10, and the cover main body portion 34 of the cover member 30. Additionally, the plate spring member 60 urges the stop pawl body 50 in a direction in which the pawl portion 53 moves into the element guide path 15 of the slider body 10.

The cover member 30 of Embodiment 1 has the cover body portion 31 arranged along the length direction, the front leg portion 32 bending at a front end portion of the cover body portion 31 and extending in the lower direction, and the rear leg portion 33 bending at a rear end portion of the cover body portion 31 and extending in the lower direction. The cover member 30 shows an inverted U-shape in a side surface view of the cover member 30. This cover member 30 is formed elastically deformable. Additionally, the cover member 30 is fixed on the slider body 10 as the front leg portion 32 being engaged with the front attachment post 21 of the slider body 10 and as the rear leg portion 33 being engaged with the rear attachment post 22 of the slider body 10.

The cover member 30 has the cover main body portion (a ceiling portion) 34 extending from the front leg portion 32 to the rear leg portion 33 via the cover body portion 31, and the right and left side surface portions 35 extending from right and left side edge portions of the cover main body portion 34 toward an inner circumferential side of the cover main body portion 34. The cover member 30 is formed in a box-shape opening in the lower direction and having a bottom surface part on an upper side. Additionally, a space portion that accommodates a part of the stop pawl body 50 and the plate spring member 60 is disposed in the cover member 30. In this case, the cover main body 34 forms a front surface portion of the front leg portion 32, an upper surface portion of the cover body portion 31, and a rear surface portion of the rear leg portion 33. The right and left side surface portions 35 of the cover member 30 are continuously disposed over the front leg portion 32, the cover body portion 31, and the rear leg portion 33.

Figure 5:
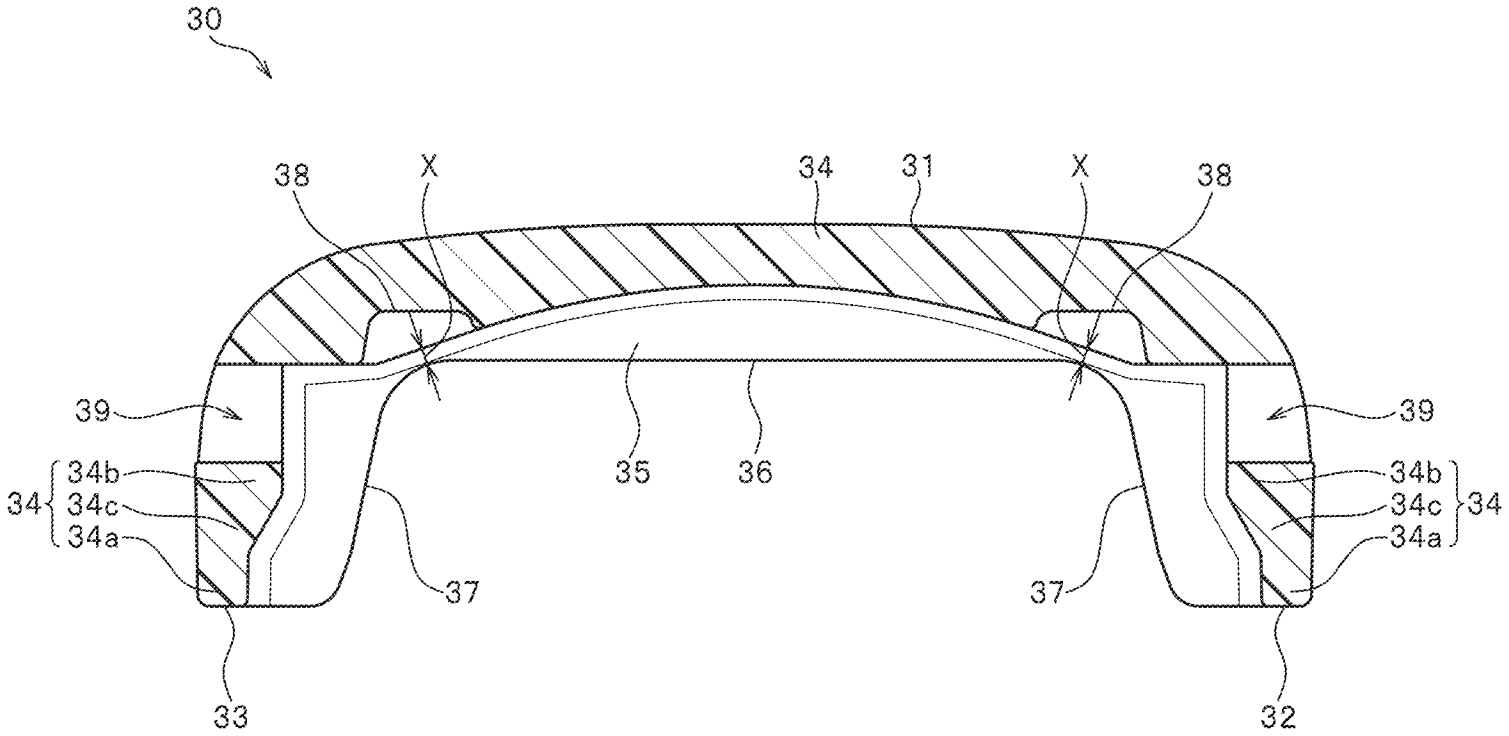
FIG. 5 is a cross-sectional view schematically illustrating a cross-section perpendicular to the width direction of a cover member of the slider according to Embodiment 1.

Inner circumferential side end edges of the right and left side surface portions 35 of the cover member 30, as shown in FIG. 5, have lower end edges 36 linearly disposed on the cover body portion 31 along the front and rear direction, and inclining end edges 37 provided on the front leg portion 32 and the rear leg portion 33, as well as arranged inclined with respect to the upper and lower direction. Additionally, the lower end edges 36 and the front and rear inclining end edges 37 are continuously formed via the inner circumferential side end edges that curves in an arc-shape. The inclining end edges 37 disposed on the front leg portion 32 and the rear leg portion 33 of the cover member 30 are arranged to face the step portions 21*g* and 22*g* formed on the front attachment post 21 and the rear attachment post 22. In this case, the inclining end edges 37 of the front leg portion 32 and the rear leg portion 33, and the step portions 21*g* and 22*g* of the front attachment post 21 and the rear attachment post 22 are apart from each other.

The cover main body portion 34 of the cover body portion 31 (that is, the upper surface portion of the cover body portion 31), as shown in FIG. 5, has an inner surface (a back surface) that curves in a depressed shape so that a middle portion of the cover main body portion 34 in the length direction is the farthest from the upper blade 20. Thereby, in case the stop pawl body 50 is pulled up against urging force of the plate spring member 60, the plate spring member 60 and the stop pawl body 50 can be made difficult to interfere the cover main body portion 34 of the cover body portion 31.

The right and left side surface portions 35 arranged on the cover body portion 31 extend from the cover main body portion 34 of the cover body portion 31 in the lower direction. Additionally, the lower end portions of the right and left side surface portions 35, as described above, have the lower end edges 36 linearly disposed along the front and rear direction. The lower end edges 36 of the right and left side surface portions 35 are in contact with four points that are upper surfaces of the right and left front first side wall portions 21*b* of the front attachment post 21, and upper surfaces of the right and left rear first side wall portions 22*b* of the rear attachment post 22 of the slider body 10. This means the cover member 30 is supported by the slider body 10 at these four points, and thereby the slider of Embodiment 1, as described below, can have a high strength against a load applied from an upper side of the cover member 30.

Each of the front leg portion 32 and the rear leg portion 33 of the cover member 30 has the cover main body portion 34 and the right and left side surface portions 35, each cross-section perpendicular to the height direction of the front leg portion 32 and the rear leg portion 33 shows a substantially U-shape.

The right and left side surface portions 35 arranged on the front leg portion 32 of the cover member 30 are disposed on an outside of the front second side wall portions 21*c* of the front attachment post 21, and cover the outer wall surfaces of the front second side wall portions 21*c*. The right and left side surface portions 35 arranged on the rear leg portion 33 of the cover member 30 are disposed on an outside of the rear second side wall portions 22*c* of the rear attachment post 22, and cover the outer wall surfaces of the rear second side wall portions 22*c*.

In this case, the right and left side surface portions 35 of the front leg portion 32 and the rear leg portion 33 are arranged to be in contact with or be close to the outer wall surfaces of the front second side wall portions 21*c* of the front attachment post 21 or the outer wall surfaces of the rear second side wall portions 22*c* of the rear attachment post 22. As the front leg portion 32, the rear leg portion 33, and the cover member 30 being disposed in this way, regions in which the outer wall surfaces of the front second side wall portions 21*c* and the inner wall surfaces of the cover member 30 are in contact with each other or superposed with each other can be secured large, as described above.

In the cover member 30 of Embodiment 1, front and rear inserting recessed portions 38 are disposed on the cover main body portion (the upper surface portion) 34 of the cover body portion 31 in which the front protruding portion 21*e* disposed on the front attachment post 21 and the rear protruding portion 22*e* disposed on the rear attachment post 22 of the slider body 10 are inserted.

Additionally, accommodating hole portions 39 are disposed on the front leg portion 32 and the rear leg portion 33 of the cover member 30 in which the front engaging pawl portion 21*d* disposed on the front attachment post 21 and the rear engaging pawl portion 22*d* disposed on the rear attachment post 22 of the slider body 10 are respectively inserted and accommodated. As the front engaging pawl portion 21*d* and the rear engaging pawl portion 22*d* of the slider body 10 being accommodated in such accommodating hole portions 39 disposed on the front leg portion 32 and the rear leg portion 33, the cover member 30 engages with and is attached to the slider body 10.

In Embodiment 1, the accommodating hole portions 39 disposed on the cover member 30 linearly penetrate the cover member 30 along the length direction. Thereby, a die used for molding the cover member 30 can be formed by a relatively simple structure, which leads reduction of manufacturing costs of the slider 1.

Additionally, each of the cover main body portion (the front surface portion) 34 of the front leg portion 32 and the cover main body portion (the rear surface portion) 34 of the front leg portion 33 has a thin portion 34*a* disposed at a lower end portion of the front leg portion 32 or the rear leg portion 33, a thick portion 34*b* disposed adjacent to the accommodating hole portion 39 with a thickness (dimensions of the front and rear direction) of the cover main body portion 34 increased more than the thin portion 34*a*, and a gradual increase portion 34*c* increasing gradually a thickness of the cover main body portion 34 from the thin portion 34*a* toward the thick portion 34*b*. As the thin portions 34*a* being disposed at the lower end portions of the front leg portion 32 and the rear leg portion 33, in assembling the slider 1, the cover member 30 can be made easy to cover the front attachment post 21 and the rear attachment post 22 of the slider body 10. Additionally, as the thick portions 34*b* being disposed adjacent to the accommodating hole portions 39 on the front leg portion 32 and the rear leg portion 33, engaging force of the cover member 30 with respect to the slider body 10 can be enhanced.

In the cover member 30 of Embodiment 1, each of the right and left side surface portions 35, for example, in a cross-sectional view perpendicular to the width direction of the cover member 30, as shown in FIG. 5, has a deformation allowable portion, in which a distance X from the cover main body portion 34 to the inner circumferential side end edge of the side surface portion 35 is the shortest, at a bending part which bends from the cover body portion 31 toward the front leg portion 32 or the rear leg portion 33. As deformation allowable portions, in which a distance X of the side surface portion 35 from the cover main body portion 34 is short, being disposed at the bending parts of the cover member 30 in this way, the cover member 30 can be made easy to elastically deform so that the front leg portion 32 and the rear leg portion 33 open to be apart from each other. Thereby, in case the cover member 30 is made to cover and engage with the front attachment post 21 and the rear attachment post 22, the cover member 30 can be made to elastically deform easily and can be assembled with the slider body 10 easily. Additionally, when the cover member 30 is made to elastically deform, it is less likely to cause damage in the right and left side surface portions 35 of the cover member 30.

Hereinafter, a manufacturing method of the slider 1 of Embodiment 1 by assembling the five components that are the slider body 10, the tab 40, the stop pawl body 50, the plate spring member 60, and the cover member 30 is explained.

First, the tab 40 is placed on the upper blade 20 of the slide body 10. At this time, the attachment shaft portion 43 of the tab 40 is inserted between the front attachment post 21 and the rear attachment post 22 of the slider body 10, as well as the front attachment post 21 or the rear attachment post 22 are inserted in the open window portion of the tab 40.

Next, the stop pawl body 50 and the plate spring member 60 are placed in order on the slider body 10 on which the tab 40 is placed. In case the stop pawl body 50 is placed on the slider body 10, the spindle portion 52 of the stop pawl body 50 is inserted in the pawl accommodating recessed portion 21*f* disposed on the front attachment post 21 of the slider body 10, as well as the pawl portion 53 of the stop pawl body 50 is inserted in the pawl hole 22*f* disposed on the rear attachment post 22 of the slider body 10. Subsequently, the plate spring member 60 is placed on the front attachment post 21 and the rear attachment post 22 so that the front protruding portion 21*e* and the rear protruding portion 22*e* of the slider body 10 are inserted in the front and rear attachment hole portions 61 of the plate spring member 60.

Then, the cover member 30 is attached to the slider body 10 on which the tab 40, the stop pawl body 50, and the plate spring member 60 are placed. At this time, the cover body portion 31 of the cover member 30 is brought close to the slider body 10 in a forward or backward inclined posture, and the front engaging pawl portion 21*d* (or the rear engaging pawl portion 22*d*) of the slider body 10 is inserted in the accommodating hole portion 39 disposed on the front leg portion 32 (or the rear leg portion 33) of the cover member 30.

Subsequently, the rear leg portion 33 (or the front leg portion 32) of the cover member 30 is pushed in the lower direction so that the inclining cover body portion 31 follows the front and rear direction. Thereby, the cover member 30 is made to elastically deform so that the front leg portion 32 and rear leg portion 33 open outside in the length direction, as well as the rear leg portion 33 (or the front leg portion 32) of the cover member 30 is made to go down. At this time, as the rear leg portion 33 (or the front leg portion 32) of the cover member 30 can be made to go down while being guided by the step portions 21*g* (or the step portions 22*g*) disposed on the rear attachment post 22 (or the front attachment post 21) of the slider body 10, a position (a position in the width direction, in particular) of the cover member 30 with respect to the slider body 10 is prevent from shifting, and assembly operations of the cover member 30 can be smoothly and stably performed.

Furthermore, when the accommodating hole portion 39 disposed on the rear leg portion 33 (or the front leg portion 32) of the cover member 30 reaches a position of the rear engaging pawl portion 22*d* (or the front engaging pawl portion 21*d*) of the slider body 10 because of the rear leg portion 33 (or the front leg portion 32) of the cover member 30 being made to go down, the cover member 30 elastically returns, as well as the rear engaging pawl portion 22*d* (or the front engaging pawl portion 21*d*) of the slider body 10 is inserted in the accommodating hole portion 39 disposed on the rear leg portion 33 (or the front leg portion 32) of the cover member 30.

Thus, the cover member 30 engages with and is attached to the front attachment post 21 and the rear attachment post 22 of the slider body 10, the slider 1 of Embodiment 1 is manufactured. Assembly operations of the slider 1 using elastic deformation of the cover member 30 as described above, can be easily and stably performed by hands, or by using an automatic assemble machine.

In the slider 1 of Embodiment 1 manufactured as described above, when the tab 40 is not operated in a free state (a non-operation state), the pawl portion 53 is made to enter in the element guide path 15 of the slider body 10 with the stop pawl body 50 being urged by the plate spring member 60. An automatic stop mechanism by the stop pawl body 50 in this way is provided in the slider 1 of Embodiment 1.

Additionally, in the slider 1 of Embodiment 1, as described above, the inner wall surfaces of the front leg portion 32 and the rear leg portion 33 of the cover member 30 are arranged to be in contact with or be close to the outer wall surfaces of the right and left front second side wall portions 21*c* and the outer wall surfaces of the right and left rear second side wall portions 22*c* disposed in the slider body 10, and in a side surface view of the slider 1, regions in which the inner wall surfaces of the cover member 30 and the front second side wall portions 21*c* and the rear second side wall portions 22*c* are in contact with each other or superposed with each other are secured large.

For this reason, even if the cover member 30 receives a load (stress) in the direction of tilting from the width direction by, for example, such as the tab 40, it is easy to catch the load in a tilting direction due to contact between the inner wall surfaces of the cover member 30, and the outer wall surfaces of the front second side wall portions 21*c* and the rear second side wall portions 22*c*. Thus, the cover member 30 can be made difficult to tilt in the width direction, as a result, attachment strength of the cover member 30 with respect to the slider body 10 can be enhanced.

Furthermore, in the slider of Embodiment 1, as described above, the right and left side surface portions 35 arranged on the cover body portion 31 of the cover member 30 extend in the upper and lower direction. Moreover, the lower end edges 36 of the right and left side surface portions 35 are in contact with the total four points that are the upper surfaces of the right and left front first side wall portions 21*b* of the front attachment post 21, and the upper surfaces of the right and left rear first side wall portions 22*b* of the rear attachment post 22 of the slider body 10, and the cover member 30 is supported at these four points. For this reason, in case the cover member 30 is pushed from the upper direction and a load (stress) in the lower direction is applied to the cover member 30, the load in the lower direction can be stably supported by contacting between the cover member 30 and such four contacting points of the front first side wall portions 21*b* and the rear first side wall portions 22*b*. Additionally, the right and left side surface portions 35 disposed on the cover body portion 31 can restrain the cover body portion 31 from deforming to bend downward. Therefore, the slider 1 of Embodiment 1 can exhibit a high strength against a load (an impact load) applied from an upper side of the cover member 30.

Embodiment 2

Figure 6:
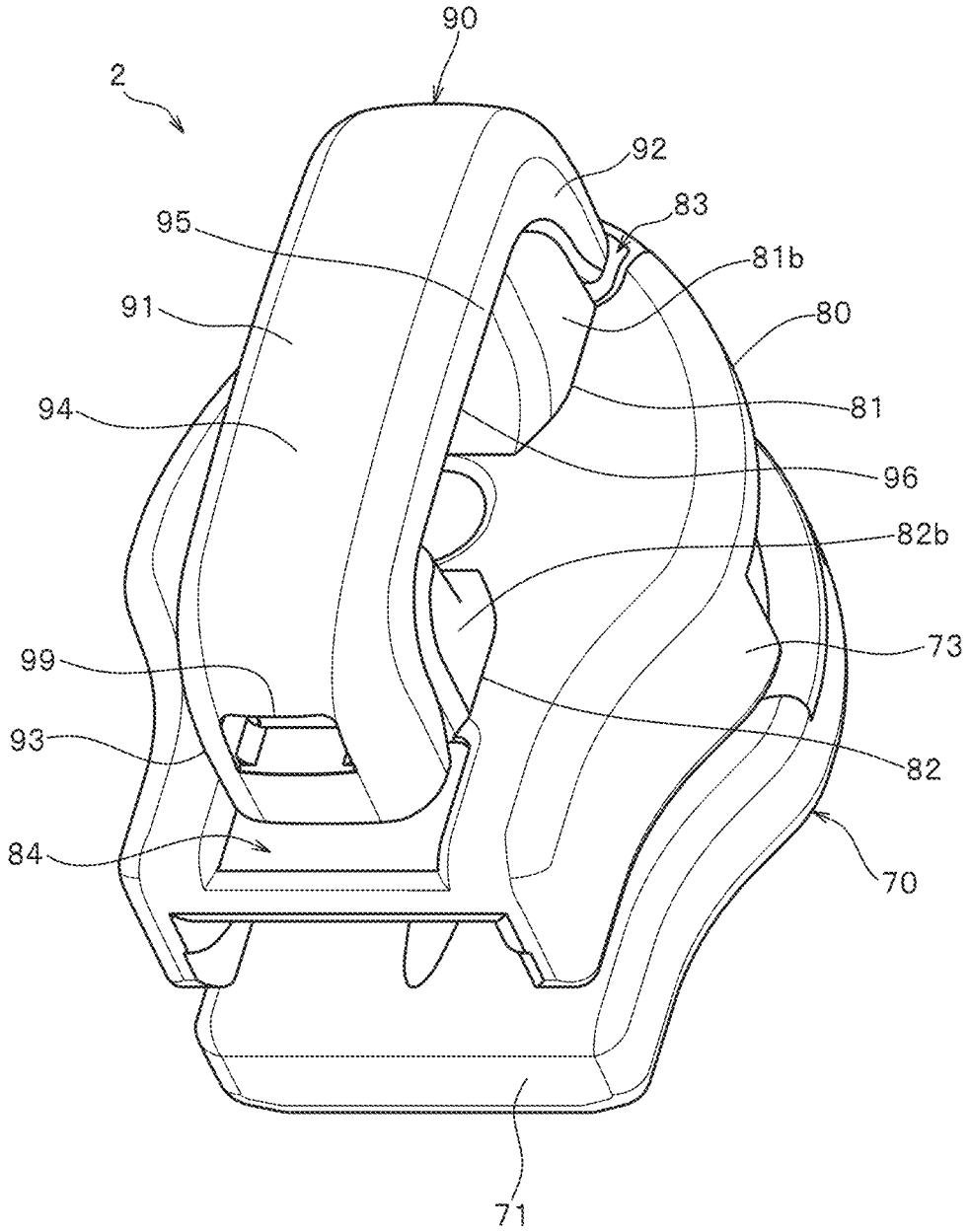
FIG. 6 is a perspective view schematically illustrating a slider according to Embodiment 2 of the invention.
Figure 7:
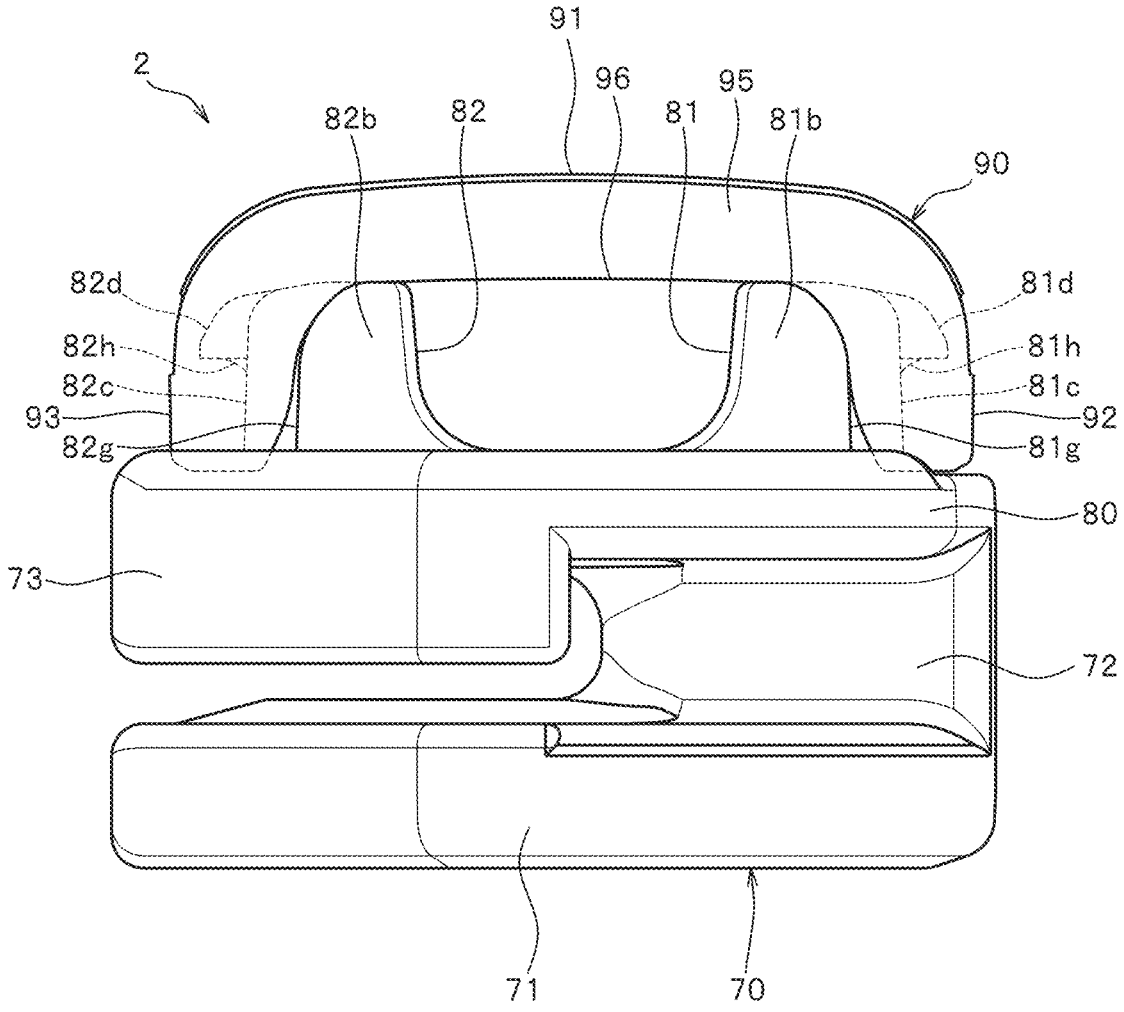
FIG. 7 is a side view of the slider according to Embodiment 2.
Figure 8:
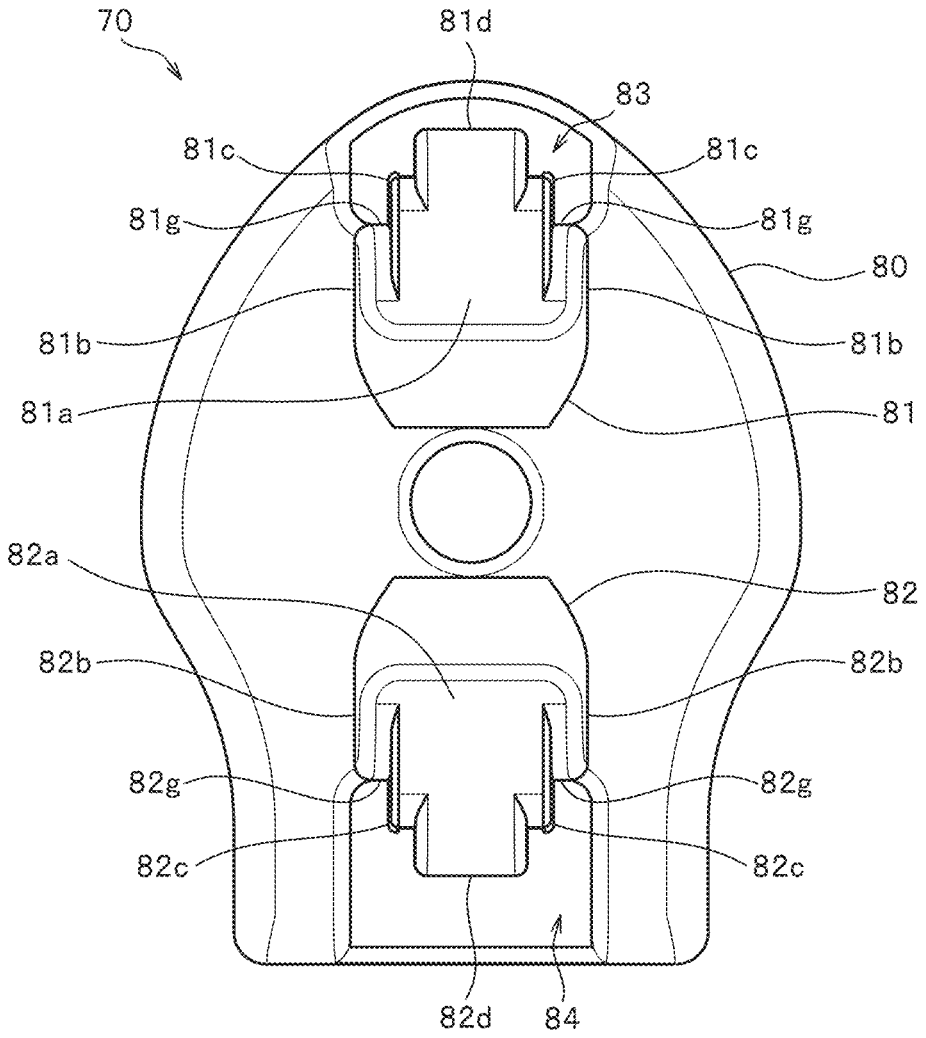
FIG. 8 is a plane view schematically illustrating a slider body of the slider according to Embodiment 2.
Figure 9:
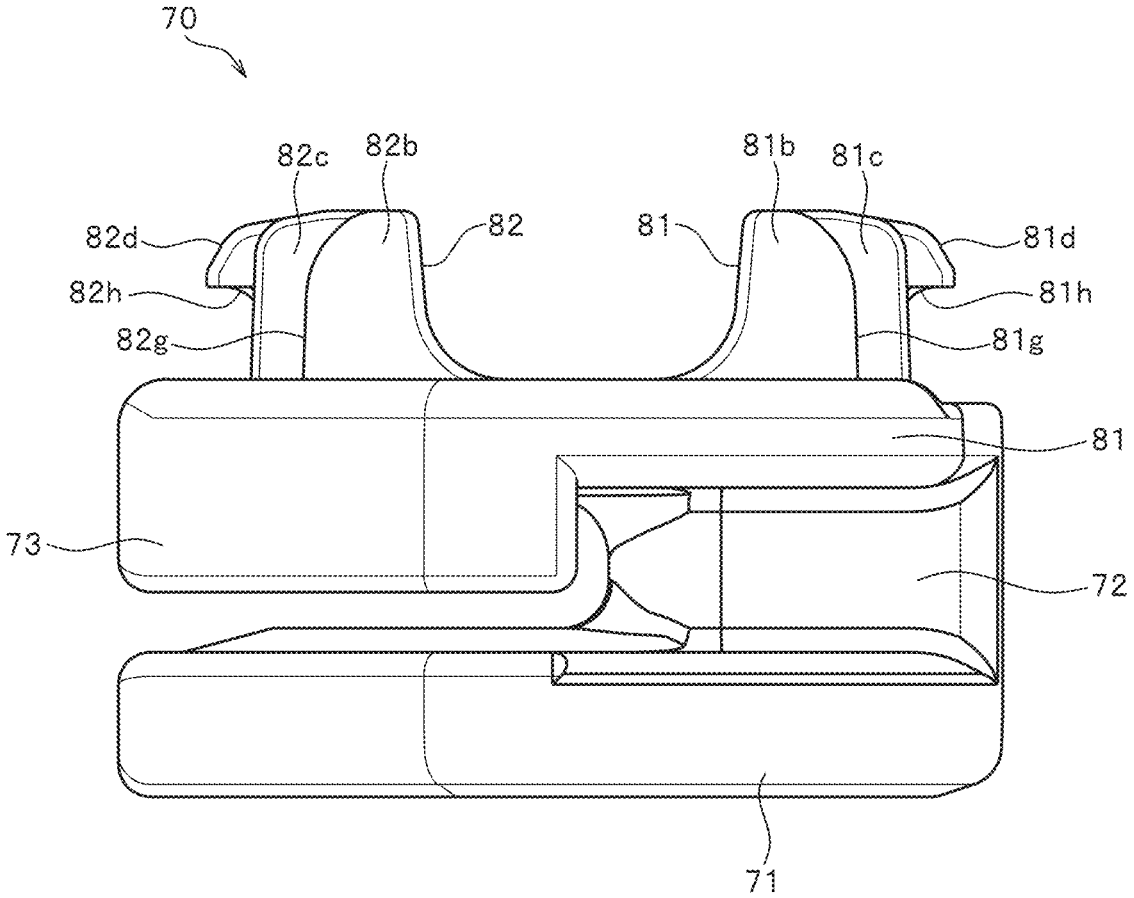
FIG. 9 is a side view of the slider body according to Embodiment 2.
Figure 10:
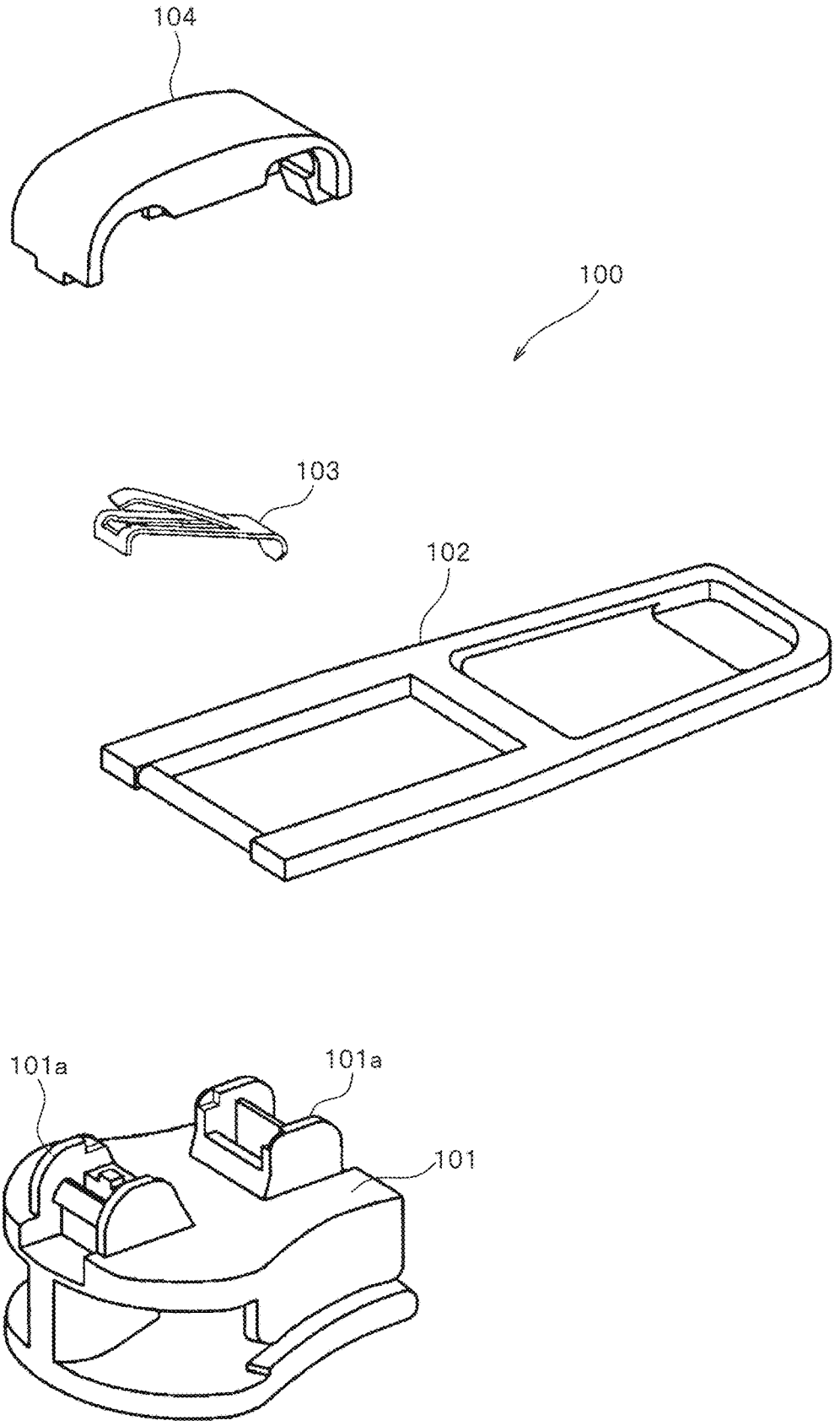
FIG. 10 is a disassembled perspective view illustrating a conventional slider in a disassembled state.

FIG. 6 and FIG. 7 are a perspective view and a side view illustrating a slider according to Embodiment 2. FIG. 8 and FIG. 9 are a plan view and a side view illustrating a slider body of the slider according to Embodiment 2. Note that, an illustration of a tab is omitted in FIG. 6 to FIG. 9.

The slider 2 for a slide fastener according to Embodiment 2 is formed as a so-called free slider 2, not having an automatic stop mechanism by such a stop pawl body 50 of the slider 1 of Embodiment 1 as described above.

Such a slider 2 of Embodiment 2 is formed by three components that are a slider body 70, a tab (not shown), and a cover member 90. Note that, the tab 40 explained in the above described Embodiment 1 can be used as an example of a tab of Embodiment 2.

The slider body 70 of Embodiment 2 has an upper blade 80, a lower blade 71, a connecting post 72 that connects a front end portion of the upper blade 80 and a front end portion of the lower blade 71, and right and left upper flange portions 73 disposed on right and left side portions of the upper blade 80. Additionally, the slider body 70 has a front attachment post 81 and a rear attachment post 82 standing up in the upper direction from the upper blade 80, a front recessed channel portion 83 disposed in the front direction of the front attachment post 81, and a rear recessed channel portion 84 disposed in the rear direction of the rear attachment post 82.

The front attachment post 81 of Embodiment 2 has a front base portion 81*a* arranged at a middle portion in the width direction of the upper blade 80, a pair of right and left front first side wall portions 81*b*, a pair of right and left front second side wall portions 81*c* arranged in the front direction of the front first side wall portions 81*b*, and a front engaging pawl portion 81*d* protruding from the front base portion 81*a* in the front direction. The front first side wall portions 81*b*, the front second side wall portions 81*c*, and the front engaging pawl portion 81*d* of Embodiment 2 are formed substantially same as the front attachment post 21 of the above described Embodiment 1.

Specifically, the right and left front first side wall portions 81*b* of Embodiment 2 have plane outer wall surfaces arranged perpendicular to the width direction of the slider 2, the outer wall surfaces of the front first side wall portions 81*b* are exposed outside. Additionally, upper end portions of the front first side wall portions 81*b* have upper end surfaces arranged parallel to an upper surface of the upper blade 80, the upper end surfaces of the front first side wall portions 81*b* are in contact with lower end portions (lower end edges 96) of right and left side surface portions 95 of a cover body portion 91. Thereby, the cover member 90 is supported from below.

The right and left front second side wall portions 81*c* of the front attachment post 81 extend from the front first side wall portions 81*b* via step portions 81*g* in the front direction. Outer wall surfaces of the right and left front second side wall portions 81*c* are formed in plane surfaces perpendicular to the width direction, and are arranged on an inside of the outer wall surfaces of the front first side wall portions 81*b* via step portions 81*g* in the width direction. As the step portions 81*g* being disposed between the front first side wall portions 81*b* and the front second side wall portions 81*c*, workability of assembly operations of the slider 2 can be improved, similar to the slider 1 of the above described Embodiment 1.

The plane outer wall surfaces of the right and left front second side wall portions 81*c* are arranged to be in contact with or be close to inner wall surfaces of a front leg portion 92 of the cover member 90, in a side surface view of the slider 2, regions in which the outer wall surfaces of the front second side wall portions 81*c* and the inner wall surfaces of the cover member 90 are in contact with each other or superposed with each other are secured large. Accordingly, the cover member 90 can be made difficult to tilt in the width direction, and attachment strength of the cover member 90 with respect to the slider body 70 can be enhanced, similar to the slider 1 of the above described Embodiment 1.

The front engaging pawl portion 81*d* of Embodiment 2, in a cross-sectional view perpendicular to the width direction of the front engaging pawl portion 81*d*, has a pawl upper surface, an inclined surface sloping downward from the pawl upper surface to a tip end portion of the front engaging pawl portion 81*d*, and a pawl lower surface 81*h* arranged from the tip end portion of the front engaging pawl portion 81*d* to a front end surface of the front base portion 81*a*. The pawl lower surface 81*h* of the front engaging pawl portion 81*d*, in a cross-section perpendicular to the width direction, has a depressed-surface-shaped curved surface that curves in an arc-shape. For this reason, a load applied to the front engaging pawl portion 81*d* from the cover member 90 can be made easy to disperse, and it is possible to restrain from damage, and the like, to occur in the front engaging pawl portion 81*d* and the front base portion 81*a*, similar to the slider 1 of the above described Embodiment 1.

The rear attachment post 82 of Embodiment 2 has a rear base portion 82*a* arranged at a middle portion in the width direction of the upper blade 80, a pair of right and left rear first side wall portions 82*b*, a pair of right and left rear second side wall portions 82*c* arranged on an outside (in the rear direction) of the rear first side wall portions 82*b* in the length direction, and a rear engaging pawl portion 82*d* protruding from the rear base portion 82*a* in the rear direction.

Although the rear first side wall portions 82*b*, the rear second side wall portions 82*c*, and the rear engaging pawl portion 82*d* of the rear attachment post 82 of Embodiment 2 are formed in the opposite direction of the front and rear direction to corresponding portions of the front attachment post 81 that are the front first side wall portions 81*b*, the front second side wall portions 81*c*, and the front engaging pawl portion 81*d*, they are formed substantially same as each corresponding portion of the front attachment post 81.

That is, the right and left rear second side wall portions 82*c* of the rear attachment post 82 extend from the rear first side wall portions 82*b* via step portions 82*g* in the rear direction. Outer wall surfaces of the rear second side wall portions 82*c* are formed in plane surfaces perpendicular to the width direction, and arranged on an inside of the outer wall surfaces of the rear first side wall portions 82*b* via step portions 82*g* in the width direction. The outer wall surfaces of the right and left rear second side wall portions 82*c* are arranged to be in contact with or be close to inner wall surfaces of a rear leg portion 93 of the cover member 90. The rear engaging pawl portion 82*d* has a pawl lower surface 82*h* arranged from a tip end portion of the rear engaging pawl portion 82*d* to a rear end surface of the rear base portion 82*a*.

The front recessed channel portion 83 that can accommodate a front side lower end portion of the cover member 90 is disposed at the front end portion of the upper blade 80, and the rear recessed channel portion 84 that can accommodate a rear side lower end portion of the cover member 90 is disposed at a rear end portion of the upper blade 80.

The cover member 90 of Embodiment 2 has the cover body portion 91, the front leg portion 92 bending at a front end portion of the cover body portion 91 and extending in the lower direction, and the rear leg portion 93 bending at a rear end portion of the cover body portion 91 and extending in the lower direction. This cover member 90 is formed elastically deformable.

The cover member 90 has a cover main body portion 94 extending from the front leg portion 92 to the rear leg portion 93 via the cover body portion 91, and the right and left side surface portions 95 extending from right and left side edge portions of the cover main body portion 94 to an inner circumferential side of the cover main body portion 94. The cover main body portion 94 forms a front surface portion of the front leg portion 92, an upper surface portion of the cover body portion 91, and a rear surface portion of the rear leg portion 93. The right and left side surface portions 95 of the cover member 90 are continuously disposed over the front leg portion 92, the cover body portion 91, and the rear leg portion 93.

Inner circumferential side end edges of the right and left side surface portions 95 of the cover member 90 have the lower end edges 96 disposed on the cover body portion 91, and inclining end edges provided on the front leg portion 92 and the rear leg portion 93, as well as arranged inclined with respect to the upper and lower direction.

The lower end edges 96 of the side surface portions 95 of the cover body portion 91 are in contact with four points that are upper end portions (upper surfaces) of the right and left front first side wall portions 81*b* of the front attachment post 81 of the slider body 70, and upper end portions (upper surfaces) of the right and left rear first side wall portions 82*b* of the rear attachment post 82, and the cover member 90 is supported by the slider body 70 at these four points. Thereby, the slider of Embodiment 2 can have a high strength against a load applied from an upper side of the cover member 90.

The right and left side surface portions 95 arranged on the front leg portion 92 of the cover member 90 are arranged to be in contact with or be close to the outer wall surfaces of the front second side wall portions 81*c* of the front attachment post 81. The right and left side surface portions 95 arranged on the rear leg portion 93 of the cover member 90 are arranged to be in contact with or be close to the outer wall surfaces of the rear second side wall portions 82*c* of the rear attachment post 82. Thereby, a region in which each outer wall surface of the front second side wall portions 81*c* and the rear second side wall portions 82*c* and each inner wall surface of the cover member 90 is in contact with each other or superposed with each other can be secured large. Thus, the cover member 90 can be made difficult to tilt in the width direction.

Additionally, accommodating hole portions 99 are disposed on the front leg portion 92 and the rear leg portion 93 of the cover member 90 in which the front engaging pawl portion 81*d* disposed on the front attachment post 81 and the rear engaging pawl portion 82*d* disposed on the rear attachment post 82 of the slider body 70 are respectively inserted and accommodated. The accommodating hole portions 99 linearly penetrate the cover member 90 along the length direction. As the front engaging pawl portion 81*d* and the rear engaging pawl portion 82*d* of the slider body 70 being accommodated in the accommodating hole portions 99 of the front leg portion 92 and the rear leg portion 93 of the cover member 90, the cover member 90 engages with and is attached to the slider body 70.

According to the above free slider 2 of Embodiment 2, similar to the above described slider 1 of Embodiment 1, attachment strength of the cover member 90 with respect to the slider body 70 can be enhanced, and the slider 2 can exhibit a high strength against a load applied from an upper side of the cover member 90.

Furthermore, in attaching the cover member 90 to the slider body 70, as the front leg portion 92 and/or the rear leg portion 93 of the cover member 90 can be guided by the step portions 81*g*, 82*g* disposed on the front attachment post 81 and/or the rear attachment post 82 of the slider body 70, a position (a position in the width direction, in particular) of the cover member 90 with respect to the slider body 70 can be prevented from shifting, and assembly operations of the cover member 90 can be smoothly and stably performed.

Note that, the slider 1 of Embodiment 1 is mainly used for a slide fastener having fastener elements made of synthetic resin formed by injection molding. Additionally, the slider 2 of Embodiment 2 is mainly used for a slide fastener having coil-shaped fastener elements. The sliders of the invention, however, can be equally applied to slide fasteners having various kinds of fastener elements, such as fastener elements made of synthetic resin and formed by injection molding, coil-shaped fastener elements, or fastener elements made of metal.

REFERENCE SIGNS LIST

1 slider
2 slider (free slider)
10 slider body
11 lower blade
12 connecting post
13 upper flange portion
14 lower flange portion
15 element guide path
20 upper blade
21 front attachment post (first attachment post)
21*a* front base portion
21*b* front first side wall portion
21*c* front second side wall portion
21*d* front engaging pawl portion
21*e* front protruding portion
21*f* pawl accommodating recessed portion
21*g* step portion
21*h* pawl lower surface
22 rear attachment post (second attachment post)
22*a* rear base portion
22*b* rear first side wall portion
22*c* rear second side wall portion
22*d* rear engaging pawl portion
22*e* rear protruding portion
22*f* pawl hole
22*g* step portion
22*h* pawl lower surface
23 front recessed channel portion
24 rear recessed channel portion
30 cover member
31 cover body portion
32 front leg portion

33 rear leg portion
34 cover main body portion
34*a* thin portion
34*b* thick portion
34*c* gradual increase portion
35 side surface portion
36 lower end edge
37 inclining end edge
38 inserting recessed portion
39 accommodating hole portion
40 tab
41 tab main body portion
42 arm portion
43 attachment shaft portion (link portion)
50 stop pawl body
51 pawl main body portion
52 spindle portion
53 pawl portion
60 plate spring member
61 attachment hole portion
70 slider body
71 lower blade
72 connecting post
73 upper flange portion
80 upper blade
81 front attachment post
81*a* front base portion
81*b* front first side wall portion
81*c* front second side wall portion
81*d* front engaging pawl portion
81*g* step portion
81*h* pawl lower surface
82 rear attachment post
82*a* rear base portion
82*b* rear first side wall portion
82*c* rear second side wall portion
82*d* rear engaging pawl portion
82*g* step portion
82*h* pawl lower surface
83 front recessed channel portion
84 rear recessed channel portion
90 cover member
91 cover body portion
92 front leg portion
93 rear leg portion
94 cover main body portion
95 side surface portion
96 lower end edge
99 accommodating hole portion
X a distance from a cover main body portion to an inner circumferential side end edge of a side surface portion

The invention claimed is:

1. A slider including:

a slider body in which an element guide path is formed between an upper blade and a lower blade; a tab having an attachment shaft portion; and a cover member that is elastically deformable, in which the element guide path communicates with right and left shoulder mouths disposed at a front end portion of the slider body in a length direction and a rear mouth disposed at a rear end portion of the slider body in the length direction, in which the slider body has a front attachment post and a rear attachment post standing up from the upper blade, and in which the cover member engages with the front attachment post and the rear attachment post using elastic deformation of the cover member, wherein each of the front attachment post and the rear attachment post has a pair of right and left first side wall portions, and a pair of right and left second side wall portions arranged on an outside of the first side wall portions in the length direction, each of outer wall surfaces of the right and left second side wall portions is arranged on an inside of each of outer wall surfaces of the right and left first side wall portions via a step portion in a width direction, the right and left first side wall portions are exposed outside, each of the right and left first side wall portions has an upper end surface arranged parallel to an upper surface of the upper blade, the cover member is supported at the right and left first side wall portions by being in contact with the upper end surfaces of the right and left first side wall portions, and includes a part apart from the step portion in a side surface view of the slider, at least a part of each of the right and left second side wall portions is accommodated in the cover member, at least a part of each of the outer wall surfaces of the right and left second side wall portions faces an inner wall surface of the cover member, the cover member has a cover body portion arranged along the length direction, a front leg portion bending at a front end portion of the cover body portion and extending toward the slider body, and a rear leg portion bending at a rear end portion of the cover body portion and extending toward the slider body, the front leg portion of the cover member engages with the front attachment post of the slider body, and the rear leg portion of the cover member engages with the rear attachment post of the slider body, the cover member has a cover main body portion extending from the front leg portion to the rear leg portion via the cover body portion, at least each of the front leg portion and the rear leg portion has right and left side surface portions extending from right and left side edge portions of the cover main body portion toward an inner circumferential side of the cover main body portion, the cover body portion has the right and left side surface portions extending from the right and left side edge portions of the cover main body portion toward the inner circumferential side of the cover main body portion, and in the side surface view of the slider, each lower end portion of the side surface portions arranged on the cover body portion faces each upper end portion of the first side wall portions of the front attachment post and the rear attachment post.

2. The slider according to claim 1, wherein each of the right and left side surface portions of the cover member, in a cross-sectional view perpendicular to the width direction of the cover member, has a deformation allowable portion in which a distance between the cover main body portion and an inner circumferential side end edge of the side surface portions is shortest at a bending part which bends from the cover body portion toward the front leg portion or the rear leg portion.

3. The slider according to claim 1, wherein each of the front attachment post and the rear attachment post has an engaging pawl portion that engages with the cover member, each of the engaging pawl portions protrudes toward an outside of the second side wall portions in the length direction, the cover member has front and rear accommodating hole portions that accommodate each of the engaging pawl portions, and each of the front and rear accommodating hole portions penetrates the cover member along the length direction.

4. The slider according to claim 3, wherein each of the engaging pawl portions of the front attachment post and the rear attachment post has a pawl lower surface that is in contact with the cover member, and each of the pawl lower surfaces, in a cross-sectional view perpendicular to the width direction of the engaging pawl portion, has a curved surface that curves in an arc-shape.

5. The slider according to claim 1, wherein the slider body has a front recessed channel portion disposed in a front direction of the front attachment post, and a rear recessed channel portion disposed in a rear direction of the rear attachment post.

* * * * *